US005927133A

United States Patent [19]

Taylor

[11] Patent Number: 5,927,133

[45] Date of Patent: Jul. 27, 1999

[54] CAMBER ADJUSTMENT TOOL

[76] Inventor: Larry J. Taylor, 2128 Manassas Run, Virginia Beach, Va. 23464

[21] Appl. No.: 09/081,298

[22] Filed: May 20, 1998

[51] Int. Cl.[6] ..... B21D 5/04

[52] U.S. Cl. ..... 72/308; 72/704; 72/705

[58] Field of Search ..... 72/308, 309, 447, 72/457, 704, 705; 29/273, 244; 254/50.1, 369, 376; 242/389

[56] References Cited

U.S. PATENT DOCUMENTS

| | | | |
|---|---|---|---|
| 336,189 | 2/1886 | White . | |
| 1,702,794 | 2/1929 | Nichols . | |
| 2,778,401 | 1/1957 | Wilkerson . | |
| 3,612,482 | 10/1971 | Eck | 72/705 |
| 4,117,709 | 10/1978 | Jackson | 72/704 |
| 4,155,537 | 5/1979 | Bronson et al. | 254/164 |
| 4,286,369 | 9/1981 | Fusco . | |
| 4,296,626 | 10/1981 | Jarman et al. | 72/705 |
| 4,424,697 | 1/1984 | Carver . | |
| 4,607,519 | 8/1986 | Kinion . | |
| 5,316,266 | 5/1994 | Chou | 254/369 |
| 5,339,508 | 8/1994 | Ventress . | |
| 5,451,202 | 9/1995 | Miller et al. . | |
| 5,598,620 | 2/1997 | Servones . | |

*Primary Examiner*—Joseph J. Hail, III
*Assistant Examiner*—Ed Tolan
*Attorney, Agent, or Firm*—Frederick F. Tsung; Payne, Gates, Farthing & Radd

[57] ABSTRACT

A pulling tool for drawing the wheel of a motor vehicle into correct camber. The pulling tool has a base on which the wheel rests during adjustment of camber. A vertical support arm projects upwardly from the base, and supports a reel controlled by a ratchet. A strap paid out from the reel engages the wheel by a hook and pulls the top of the wheel towards the vertical support arm when the reel draws in the strap. A brace pivotally fixed to the vertical support arm includes two struts propped against the wheel, and prevents the vertical support arm from being drawn ineffectually towards the wheel. The base is bent to form an offset portion at that end to which the vertical support arm is connected, so that the novel tool may overlie a side rail of a conventional alignment rack without interference. The base and vertical support arm are separable. The top of the base has tread.

22 Claims, 2 Drawing Sheets

CAMBER ADJUSTMENT TOOL

BACKGROUND OF THE INVENTION

1. Field of the Invention

The present invention relates to apparatus for aligning wheels of a motor vehicle. More specifically, the invention comprises apparatus which is pinned down by the weight of the vehicle, and includes a ratcheting pulling device which engages the wheel and draws the wheel into a desired position.

2. Description of the Prior Art

As motor vehicles are driven in ordinary use, their wheels inevitably encounter bumps and obstructions in the road which over time cause the wheel to depart from predetermined orientation to the chassis. This condition is known in the field as being out of alignment, causes greatly accelerated tire wear, and may impair steering of the vehicle. To correct this condition, trained personnel must mount the vehicle on an apparatus which is capable of measuring discrepancy of each wheel from the predetermined factory specification. The wheel is pulled into a position corresponding to the specified position, and is tightened in this position.

Force considerably greater than that readily achieved by hand is required. For this reason, professional aligning equipment may include powered pulling or pushing elements, or both, which may be temporarily brought to bear on the wheel, in addition to measuring apparatus for determining correct position.

Wheel alignment tools are shown in U.S. Pat. No. 2,778,401, issued to E. D. Wilkerson on Jan. 22, 1957, and U.S. Pat. No. 5,598,620, issued to Pedro A. Servones on Feb. 4, 1997. Both of the subject devices brace against the wheel or suspension receiving adjustment. However, neither subject device includes a ratchet, and neither is anchored by a member disposed below and receiving weight resting on the wheel being adjusted. Although the brace of Wilkerson engages its associated wheel near the ground, very little weight bears effectively on an anchoring member. By contrast, the present invention includes both a ratchet device and a member disposed below and anchored by weight of the wheel being adjusted.

U.S. Pat. No. 336,189, issued to Nicholas White on Feb. 16, 1886, and U.S. Pat. No. 5,451,202, issued to Forrest A. Miller et al. on Sep. 19, 1995, describe pulling devices employing ratchets. However, neither of the latter two prior art patents includes a member disposed below the object subject to pulling forces for anchoring the subject pulling device. Neither of these prior art patents includes a hook suitable for engaging a wheel of a motor vehicle, as provided in the present invention. Further, neither prior art invention has a brace hinged to the ratchet mechanism, as has the present invention.

None of the above inventions and patents, taken either singly or in combination, is seen to describe the instant invention as claimed.

SUMMARY OF THE INVENTION

The present invention provides a pulling tool uniquely suited to pull a wheel into a position relative to its suspension corresponding to factory specifications regarding camber. The tool is conveniently employed in conjunction with a conventional alignment rack onto which a motor vehicle to be aligned is driven. The tool enables a wheel to be subjected to a pulling force suitable for returning a wheel disposed excessively in negative camber to proper camber.

The tool includes a horizontal base onto which the wheel being adjusted is driven, thereby anchoring the tool. A vertical member is removably fixed to the exposed end of the base. When not in use, detachment of the vertical member from the base enables compact stowage of the novel tool. A ratchet mechanism is fixed to the vertical member such that a cable or strong strap paid out from the ratchet mechanism extends to the distal side of the wheel being adjusted. This strap terminates in a hook suitable for engaging the wheel such that when the ratchet mechanism draws in the cable, the top of the wheel is pulled towards the ratchet mechanism.

A brace hinged to the vertical member supporting the ratchet is placed against the wheel, thereby preventing the ratchet mechanism from being drawn ineffectually toward the wheel. The brace includes two arms for symmetrical support of the ratchet mechanism while propping the tool against the wheel being adjusted. Hinging of the brace to the vertical member accommodates different wheel heights and locations of the wheel on the horizontal base.

The ratchet mechanism enables work to be halted temporarily for the purpose of ascertaining the actual alignment of the wheel, since the ratchet prevents reversal. Grasp of the tool may be relinquished without changing the last attained position of the wheel while the actual alignment is checked visually or is measured. Also, the pull exerted by the tool can be imposed in small increments, thereby enabling fine adjustments.

The hook is generally universally applicable to standard wheels for motor vehicles. No other specially designed feature is required to enable the novel tool to cooperate with most commercially produced motor vehicles in order to be effective.

Accordingly, it is one object of the invention to provide a pulling tool suitable for pulling the wheel of a motor vehicle into correct camber.

It is another object of the invention that the novel tool be compatible with conventional alignment racks.

It is a further object of the invention to employ the weight of the vehicle to anchor the novel pulling tool.

Still another object of the invention is to avoid specialized configuration for cooperating with individual motor vehicles.

An additional object of the invention is to enable compact stowage of the novel tool.

It is again an object of the invention to enable pulling to be halted, with grasp of the tool relinquished, without changing the last attained position of the wheel.

It is a further object of the invention to prop the tool securely against the wheel being adjusted.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
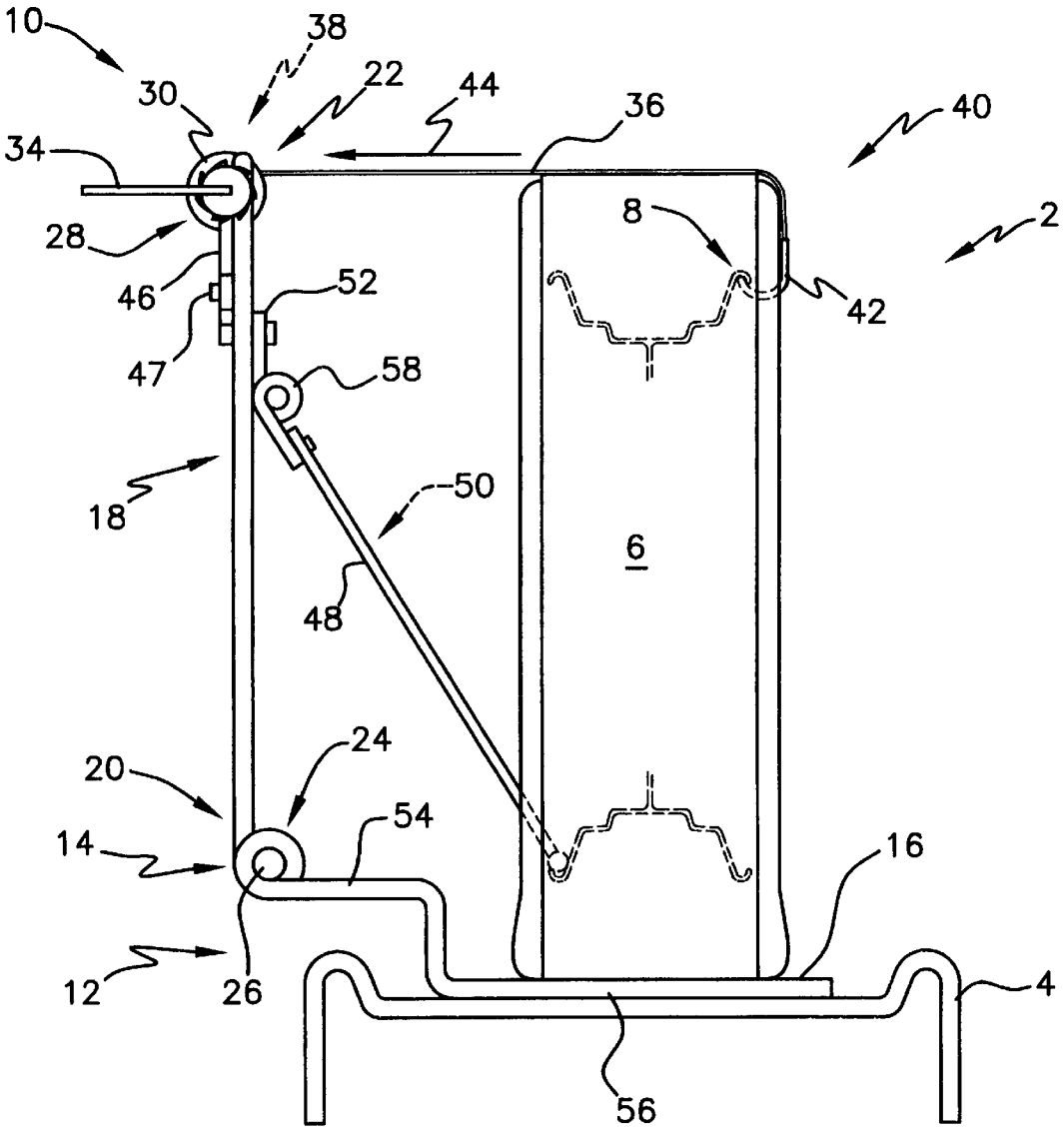
FIG. 1 is an environmental, side elevational view of the invention.

Turning now to FIG. 1 of the drawings, pulling tool 10 is shown mounted to a wheel 2 of a motor vehicle (not shown in its entirety), for the purpose of adjusting camber of wheel 2. As depicted in FIG. 1, adjustment may be performed with wheel 2 operably mounted on the vehicle, and in fact is preferred so that the vehicle may be driven under its own power onto alignment rack 4. Tool 10 comprises a base 12 having a proximal end 14 and a horizontal upper surface 16. Tire 6 of wheel 2 comes to rest on surface 16, thereby pinning tool 10 into operable position on rack 4.

A vertical support arm 18 having a lower end 20 and an upper end 22 is connected to proximal end 14 of base 12 at lower end 20 of vertical support arm 18 such that vertical support arm 18 projects upwardly from base 12. Preferably, base 12 and vertical support arm 18 each has curved fingers or equivalent connectably compatible elements cooperating to form a piano hinge 24. Individual fingers of piano hinge 24 slidably interfit in the absence of pin 26, so that vertical support arm 18 is pivotally and separably attached to base 12.

A ratchet mechanism 28 is mounted to vertical support arm 18 proximate upper end 22 of vertical arm 18. A reel 30 is rotatably mounted to ratchet mechanism 28 by a central shaft 32 (see FIG. 2) common to both ratchet mechanism 28 and reel 30. Shaft 32 terminates in an operating lever or crank handle 34, for turning ratchet mechanism 28 and reel 30.

Reel 30 is employed to retain a strap 36 one end 38 of which is attached to reel 30 for winding purposes, and a free end 40 terminating in a hook 42. This arrangement enables reel 30 to pay out strap 36 from reel 30 and to wind strap 36 onto reel 30 when reel 30 rotates on shaft 32. Hook 42 is configured to engage commercially available wheels having outwardly turned flanges 8. Strap 36 is shown in its operative position relative to wheel 2 and reel 30. When reel 30 is rotated in a direction drawing strap 36 onto reel 30, strap 36 will exert a pulling force against the top of wheel 2, as indicated by arrow 44. This pulling force will bring wheel 2 into correct camber condition under most circumstances. Pulling is periodically halted in order to check the actual position of wheel 2 relative to factory specifications. Ratchet mechanism 28 prevents tension from unwinding strap 36 from reel 30 and thereby enabling wheel 2 to return to its original position while its position is checked. Checking is performed with equipment unrelated to novel pulling tool 10. When wheel 2 is secured in an appropriate camber condition, pawl 46 is rotated out of engagement with the teeth of ratchet mechanism 28, and strap 36 is slackened for removal from engagement with wheel 2. Pawl 46 is pivotally mounted to vertical support arm 18 at a bolt 47.

As tension increases while pulling forces are exerted, vertical support member 18 is supported against being drawn towards wheel 2 by bracing arms 48, 50. Bracing arms 48, 50 are connected to vertical support arm 18 at a hinged bracket 52 and are placed so as to rest against wheel 2, thereby bracing vertical support arm 18 when strap 36 engages wheel 2 and is wound onto reel 30.

Base 12 has an upwardly projecting offset portion 54 at proximal end 14 of base 12. Vertical support arm 18 is connected to base 12 at offset portion 54 of base 12. That portion of base 12 contacting the horizontal section of rack 4 is designated supporting portion 56, which bears the weight of the vehicle carried by wheel 2. Offset portion 54 is disposed entirely above the level of supporting portion 56 of base 12 when supporting portion 56 lies on the horizontal section of rack 4, or on any horizontal environmental surface. Bracket 52 has a swiveling element in the form of hinge 58 disposed thereon for rotatably mounting or connecting bracing arms 48, 50 to vertical support arm 18. This swiveling element enables abutting contact by bracing arms 48, 50 with wheel 2. In particular, wheels of different dimensions and configurations are accommodated, as well as spacing of wheel 2 from vertical support arm 18.

Figure 2:
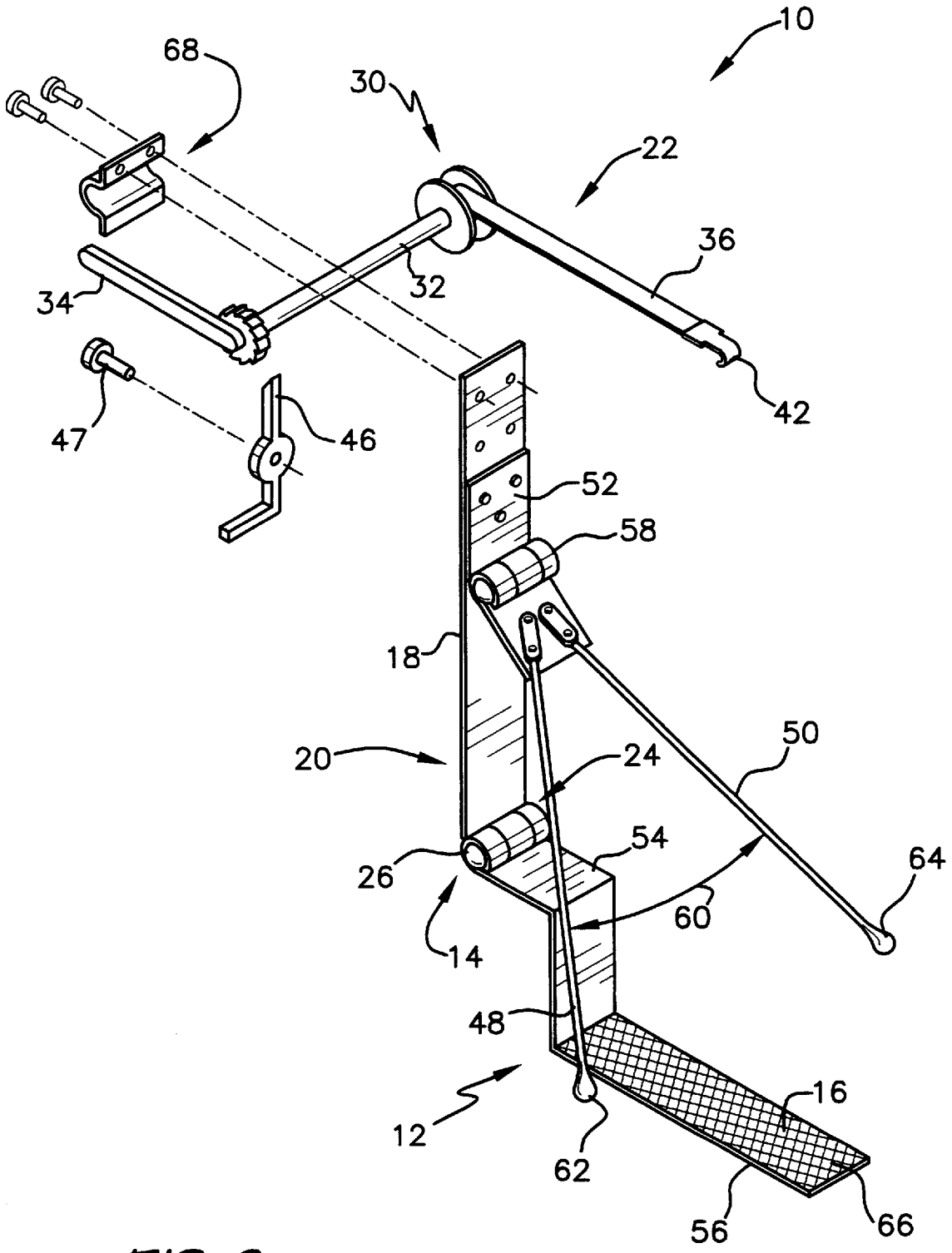
FIG. 2 is a partially exploded, perspective view of the invention.

Turning now to FIG. 2, bracing arms 48, 50 are seen to comprise two struts disposed to occupy one plane and to form an acute angle (indicated by 60) between the two struts when the struts rest against wheel 2. Each bracing arm 48 or 50 has a cap 62 or 64 formed from a resilient material such as rubber or a synthetic resin exhibiting frictional characteristics greater than those of the constituent material of its associated bracing arm 48 or 50. Caps 62, 64 are enlarged compared to the ends of bracing arms 48, 50, and enable the latter to seat securely against wheel 2.

FIG. 2 also illustrates the nature of base 12, which is generally planar apart from nominal thickness of the constituent material. Upper horizontal surface 16 bears tread 66 for preventing tire 6 from slipping readily on base 12.

Shaft 32 is secured by any suitable method to vertical support arm 18, such as by pillow block 68. Pillow block 68 and bracket 52 are bolted to vertical support arm 18.

It is to be understood that the present invention is not limited to the embodiments described above, but encompasses any and all embodiments within the scope of the following claims.

I claim:

1. A pulling tool suited to adjust camber of a wheel of a motor vehicle without contacting the wheel's supporting strut, said pulling tool comprising:

a base having a proximal end and a horizontal upper surface;

a vertical support arm having a lower end and an upper end, wherein said vertical support arm is connected to said proximal end of said base at said lower end of said vertical support arm, and said vertical support arm projects upwardly from said base;

a ratchet mechanism including a reel rotatably mounted to said ratchet mechanism, said ratchet mechanism fixed to said vertical support arm proximate said upper end of said vertical support arm;

a strap having a first end attached to said reel and disposed to pay out from said reel and to wind onto said reel when said reel rotates, and a free end terminating in a hook configured to engage the wheel at a top inward portion thereof; and a bracing arm connected to said vertical support arm and disposed to rest against the wheel at a bottom outward portion thereof so as to brace said vertical support arm when said strap engages the wheel of the motor vehicle by said hook and is wound onto said reel.

2. The pulling tool according to claim 1, wherein said base includes first separable attachment elements and said vertical support arm includes second separable attachment elements connectably compatible with said first attachment elements of said base, for attaching said base to said vertical support arm.

3. The pulling tool according to claim 1, wherein said ratchet mechanism and said reel have a common central shaft having a crank handle.

4. The pulling tool according to claim 1, further comprising a hinge disposed to mount said bracing arm rotatably to said vertical support arm.

5. The pulling tool according to claim 1, wherein said bracing arm has a cap formed from a resilient material exhibiting frictional characteristics greater than those of said bracing arm.

6. The pulling tool according to claim 1, further comprising a swiveling element rotatably connecting said bracing arm to said vertical support arm.

7. The pulling tool according to claim 1, wherein said base is generally planar and said horizontal upper surface of said base bears tread.

8. A pulling tool suited to adjust camber of a wheel of a motor vehicle, comprising:

a base having a proximal end and a horizontal upper surface;

a vertical support arm having a lower end and an upper end, wherein said vertical support arm is connected to said proximal end of said base at said lower end of said vertical support arm, and said vertical support arm projects upwardly from said base;

a ratchet mechanism including a reel rotatably mounted to said ratchet mechanism, said ratchet mechanism fixed to said vertical support arm proximate said, upper end of said vertical support arm;

a strap having a first end attached to said reel and disposed to pay out from said reel and to wind onto said reel when said reel rotates, and a free end terminating in a hook; and a bracing arm connected to said vertical support arm and disposed to rest against the wheel of the motor vehicle so as to brace said vertical support arm when said strap engages the wheel of the motor vehicle by said hook and is wound onto said reel;

wherein said base has an upwardly projecting offset portion at said proximal end of said base and a supporting portion, said offset portion disposed entirely above the level of said supporting portion of said base when said supporting portion of said base lies on a horizontal environmental surface, and wherein said vertical support arm is connected to said base at said offset portion of said base.

9. The pulling tool according to claim 8, wherein said base includes first separable attachment elements and said vertical support arm includes second separable attachment elements connectably compatible with said first attachment elements of said base, for attaching said base to said vertical support arm.

10. The pulling tool according to claim 8, wherein said ratchet mechanism and said reel have a common central shaft having a crank handle.

11. The pulling tool according to claim 8, further comprising a hinge disposed to mount said bracing arm rotatably to said vertical support arm.

12. The pulling tool according to claim 8, wherein said bracing arm has a cap formed from a resilient material exhibiting frictional characteristics greater than those of said bracing arm.

13. The pulling tool according to claim 8, further comprising a swiveling element rotatably connecting said bracing arm to said vertical support arm.

14. The pulling tool according to claim 8, wherein said base is generally planar and said horizontal upper surface of said base bears tread.

15. A pulling tool suited to adjust camber of a wheel of a motor vehicle, comprising:

a base having a proximal end and a horizontal upper surface;

a vertical support arm having a lower end and an upper end, wherein said vertical support arm is connected to said proximal end of said base at said lower end of said vertical support arm, and said vertical support arm projects upwardly from said base;

a ratchet mechanism including a reel rotatably mounted to said ratchet mechanism, said ratchet mechanism fixed to said vertical support arm proximate said upper end of said vertical support arm;

a strap having a first end attached to said reel and disposed to pay out from said reel and to wind onto said reel when said reel rotates, and a free end terminating in a hook; and a bracing arm connected to said vertical support arm and disposed to rest against the wheel of the motor vehicle so as to brace said vertical support arm when said strap engages the wheel of the motor vehicle by said hook and is wound onto said reel;

wherein said bracing arm comprises two struts disposed to occupy one plane and to form an acute angle between said two struts when said struts rest against the wheel of the motor vehicle.

16. The pulling tool according to claim 15, wherein said base includes first separable attachment elements and said vertical support arm includes second separable attachment elements connectably compatible with said first attachment elements of said base, for attaching said base to said vertical support arm.

17. The pulling tool according to claim 15, wherein said ratchet mechanism and said reel have a common central shaft having a crank handle.

18. The pulling tool according to claim 15, further comprising a hinge disposed to mount said bracing arm rotatably to said vertical support arm.

19. The pulling tool according to claim 15, wherein said bracing arm has a cap formed from a resilient material exhibiting frictional characteristics greater than those of said bracing arm.

20. The pulling tool according to claim 15, further comprising a swiveling element rotatably connecting said bracing arm to said vertical support arm.

21. The pulling tool according to claim 15, wherein said base is generally planar and said horizontal upper surface of said base bears tread.

22. A pulling tool suited to adjust camber of a wheel of a motor vehicle, comprising:

a generally planar base having a proximal end and a horizontal upper surface bearing tread, wherein said base has an upwardly projecting offset portion at said proximal end of said base and a supporting portion, said offset portion disposed entirely above the level of said supporting portion of said base when said supporting portion of said base lies on a horizontal environmental surface;

a vertical support arm having a lower end and an upper end, said vertical support arm having a hinge connecting said vertical support arm to said proximal end of said base at said lower end of said vertical support arm, said hinge having a removable pin, said vertical support arm projecting upwardly from said base, and wherein said vertical support arm is connected to said base at said offset portion of said base;

a ratchet mechanism including a reel rotatably mounted to said ratchet mechanism, said ratchet mechanism fixed to said vertical support arm proximate said upper end of said vertical support arm, wherein said ratchet mechanism and said reel have a common central shaft having a crank handle;

a strap having a first end attached to said reel and disposed to pay out from said reel and to wind onto said reel when said reel rotates, and a free end terminating in a hook; and a bracing arm connected to said vertical support arm and disposed to rest against the wheel of the motor vehicle so as to brace said vertical support arm when said strap engages the wheel of the motor vehicle by said hook and is wound onto said reel, said bracing arm including a swiveling element rotatably connecting said bracing arm to said vertical support arm, and two struts disposed to occupy one plane and to form an acute angle between said two struts when said struts rest against the wheel of the motor vehicle, each said strut having a cap formed from a resilient material exhibiting frictional characteristics greater than those of said bracing arm.

* * * * *